US008480423B2

(12) United States Patent
O'Sullivan et al.

(10) Patent No.: US 8,480,423 B2
(45) Date of Patent: Jul. 9, 2013

(54) CONTACT REGION OF AN ELECTRICALLY CONDUCTIVE MEMBER

(75) Inventors: Edward O'Sullivan, Cary, NC (US); Harry George Yaworski, Cary, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/210,412

(22) Filed: Aug. 16, 2011

(65) Prior Publication Data

US 2013/0045622 A1 Feb. 21, 2013

(51) Int. Cl.
*H01R 13/28* (2006.01)

(52) U.S. Cl.
USPC ..... 439/287

(58) Field of Classification Search
USPC ..... 439/287, 801, 883
See application file for complete search history.

(56) References Cited

U.S. PATENT DOCUMENTS

| | | | | | |
|---|---|---|---|---|---|
| 53,219 | A * | 3/1866 | Fawcett | 403/340 |
| 195,988 | A * | 10/1877 | Culter | 403/341 |
| 281,730 | A * | 7/1883 | Ricketts | 439/287 |
| 613,663 | A * | 11/1898 | Case | 403/340 |
| 709,400 | A * | 9/1902 | Fitzpatrick | 403/341 |
| 835,211 | A * | 11/1906 | Atkinson | 403/339 |
| 867,312 | A * | 10/1907 | Shutz | 403/341 |
| 925,293 | A * | 6/1909 | Cheney | 403/340 |
| 1,003,973 | A * | 9/1911 | Barrickman | 403/340 |
| 1,975,244 | A * | 10/1934 | Wiseman | 439/287 |
| 2,523,465 | A * | 9/1950 | Graham | 439/287 |
| 2,968,788 | A * | 1/1961 | Neaderland et al. | 439/883 |
| 3,220,757 | A * | 11/1965 | Potter | 403/340 |
| 3,990,810 | A * | 11/1976 | Amos et al. | 415/161 |
| 4,604,030 | A * | 8/1986 | Naudet | 415/126 |
| 4,679,888 | A * | 7/1987 | Williams | 439/883 |
| 4,710,131 | A * | 12/1987 | Bonenberger | 439/13 |
| 4,832,629 | A * | 5/1989 | Sasaki et al. | 439/792 |
| 5,007,762 | A * | 4/1991 | Duran | 403/341 |
| 5,398,978 | A * | 3/1995 | Gagnon | 285/184 |
| 5,413,500 | A * | 5/1995 | Tanaka | 439/521 |
| 5,439,309 | A * | 8/1995 | Raz | 403/316 |
| 5,507,664 | A * | 4/1996 | Carmo | 439/372 |
| 5,688,069 | A * | 11/1997 | Hoshino | 403/340 |
| 5,853,375 | A * | 12/1998 | Orr | 600/585 |
| 6,053,780 | A * | 4/2000 | Ono et al. | 439/810 |
| 6,398,595 | B2 * | 6/2002 | Wakata et al. | 439/755 |
| 6,422,888 | B1 * | 7/2002 | Goble | 439/341 |
| 6,487,430 | B1 * | 11/2002 | Henderson et al. | 600/394 |
| 6,695,620 | B1 * | 2/2004 | Huang | 439/11 |
| 6,878,005 | B2 * | 4/2005 | Varone et al. | 439/347 |
| 6,969,276 | B2 * | 11/2005 | Ono et al. | 439/518 |
| 7,160,157 | B1 * | 1/2007 | Jones et al. | 439/883 |
| 7,203,067 | B2 * | 4/2007 | Beall et al. | 361/726 |
| 7,513,709 | B2 * | 4/2009 | Shimada et al. | 403/399 |
| 7,553,166 | B2 * | 6/2009 | Gobron | 439/67 |
| 7,731,669 | B2 * | 6/2010 | Mathews et al. | 600/585 |

(Continued)

*Primary Examiner* — Briggitte R Hammond
*Assistant Examiner* — Vladimir Imas

(57) ABSTRACT

A contact region of an electrically conductive member includes a contact area, a shroud and at least one projection. The contact area is provided to electrically engage a mating connector. The shroud is positioned proximate the contact area and is dimensioned to cooperate with a portion of the mating connector to align the mating connector in the contact area. The at least one projection is provided proximate the contact area, such that the at least one projection cooperates with a mating connector to limit the rotation of the mating connector relative to the contact area.

16 Claims, 5 Drawing Sheets

U.S. PATENT DOCUMENTS 7,887,380 B2 * 2/2011 Ross ..... 439/883
7,901,243 B1 3/2011 Yaworski
7,914,300 B2 3/2011 Akahori et al.
8,105,103 B2 * 1/2012 Nishio et al. ..... 439/287
8,235,420 B2 * 8/2012 Moriyama et al. ..... 280/777
2004/0019288 A1 * 1/2004 Kinast ..... 600/509

* cited by examiner

CONTACT REGION OF AN ELECTRICALLY CONDUCTIVE MEMBER

FIELD OF THE INVENTION

The present invention is directed to a contact region of an electrically conductive member and, more particularly, to an area of a busbar or the like which allows for ease of installation and provides electrical and physical reliability over time.

BACKGROUND OF THE INVENTION

Disconnectable busbars having contact regions or joint assemblies are commonly used in various applications, including electrical power transmission networks. Disconnectable joint assemblies are useful, for example, where a utility may need the ability to disconnect a joint to sectionalize a piece of cable for repair. By way of example, a bad or damaged cable may be disconnected from the busbar to remove the cable from the circuit in a quick and efficient manner, and then reconnected to the busbar after the repair is made. In many instances, the busbar includes a contact area with one or more flat pad surfaces, lugs, or posts which are configured to mate with a standard terminal lug. The terminal lugs are generally disconnectably and reconnectably secured to the flat pad surfaces, lugs or posts by a bolt or the like, for example.

Typical busbars 2, as shown in FIGS. 1 and 2, use a flat pad surface 3 at an end 4 of the busbar 2 which is configured to mate with the terminal lug 5 or the like. A vertical wall 6 which is perpendicular to the edges 7 of the pad surface 3 is traditionally adjacent to the pad surface 3. This type of design is problematic for both the electrical and mechanical connection of the terminal lug 5. As the terminal lug 5 is secured by only one bolt (not shown) located at position 8, the terminal lug 5 can rotate about the bolt at position 8, causing the bolt at position 8 to loosen if the terminal lug 5 is allowed to rotate excessively (as shown in FIG. 2), thereby causing intermittent electrical and/or mechanical problems or failure. In addition, excessive rotation or movement of the terminal lug 5 creates a non in-line installation which makes it difficult to install outer shrinkable insulating tubing over the connection, thereby affecting the mechanical connection therebetween. Additionally, the perpendicular vertical wall 6 adjacent the pad surface 3 creates a catch point for the rip cord of a cold shrinkable joint, making the installation thereof difficult.

It would, therefore, be beneficial to provide a contact region of an electrical conductive member which addresses the concerns of the prior art and provides both a reliable electrical connection and a reliable mechanical connection.

SUMMARY OF THE INVENTION

An exemplary embodiment of a contact region of an electrically conductive member includes a contact area and an arcuate shroud. The contact area is provided to electrically engage a mating connector. The arcuate shroud is positioned proximate the contact area. The arcuate shroud is dimensioned to cooperate with a portion of the mating connector to align the mating connector in the contact area.

An exemplary embodiment of a contact region of an electrically conductive member includes a contact area and at least one projection. The contact area is provided to electrically engage a mating connector. The at least one projection is provided proximate the contact area, such that the at least one projection cooperates with a mating connector to limit the rotation of the mating connector relative to the contact area.

An exemplary embodiment of a contact region of an electrically conductive member includes a contact area, a shroud and at least one projection. The contact area is provided to electrically engage a mating connector. The shroud is positioned proximate the contact area and is dimensioned to cooperate with a portion of the mating connector to align the mating connector in the contact area. The at least one projection is provided proximate the contact area, such that the at least one projection cooperates with a mating connector to limit the rotation of the mating connector relative to the contact area.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
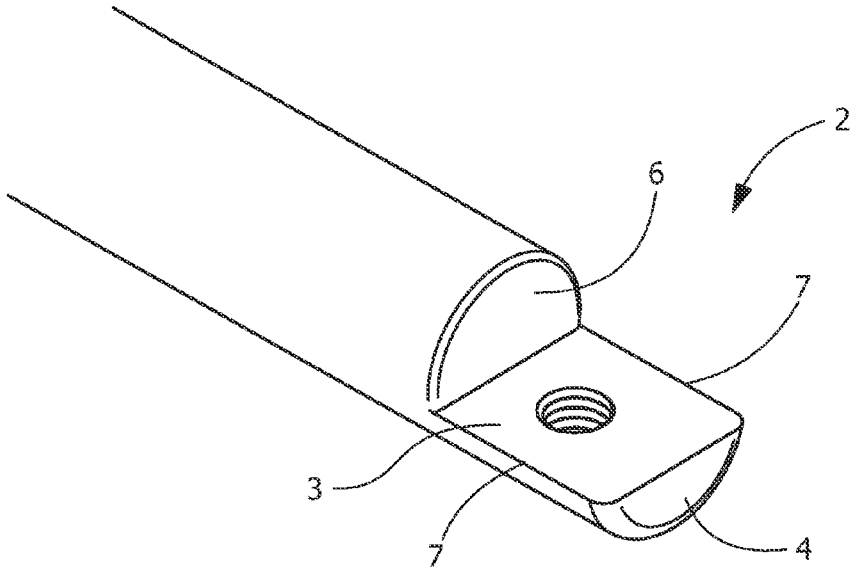
FIG. 1 PRIOR ART
FIG. 1 is a perspective view of a contact area of a busbar according to the prior art.
Figure 2:
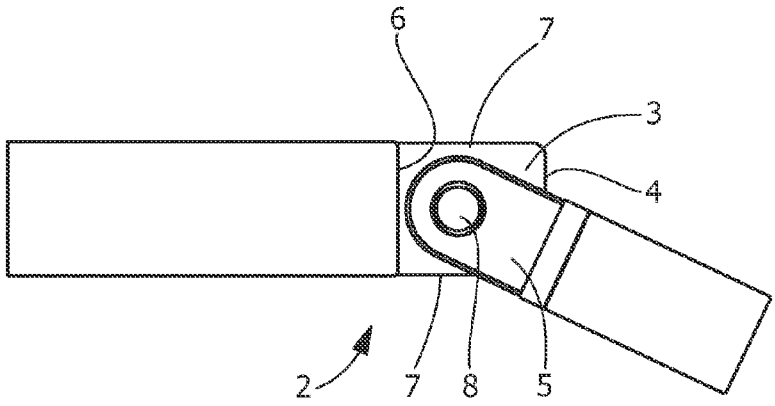
FIG. 2 PRIOR ART
FIG. 2 is a top view of the contact area of the busbar of FIG. 1 and a mating connector, showing the mating connector rotated relative to the contact area.

The present invention will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that spatially relative terms, such as "over", "upper", "vertical" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "over" other elements or features would then be oriented "under" the other elements or features. Thus, the exemplary term "over" can encompass both an orientation of over and under. The device may be otherwise oriented (rotated 90 degrees or at other orientations) and the spatially relative descriptors used herein interpreted accordingly.

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise.

Figure 3:
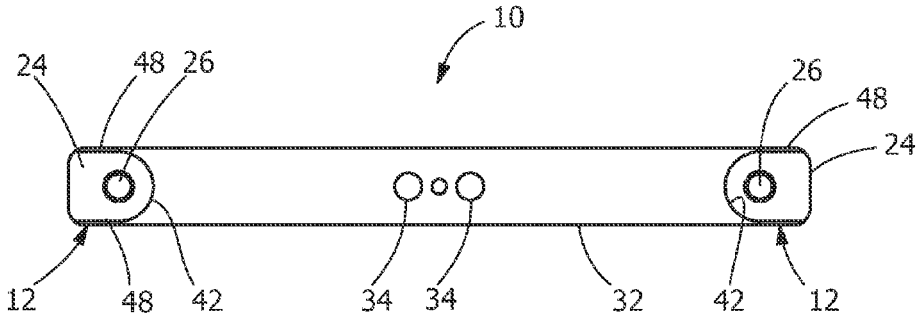
FIG. 3 is a top view of an exemplary embodiment of an electrically conductive member with a contact area according to the present invention.
Figure 10:
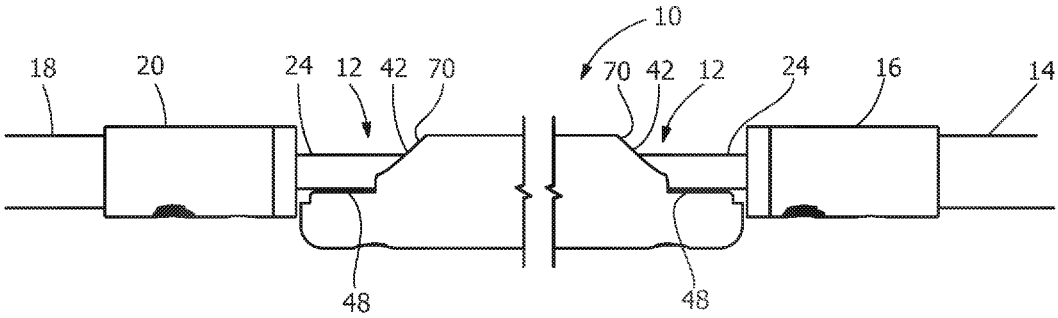
FIG. 10 is a side view of the electrically conductive member with contact areas on either side and mating connectors prior to being secured thereto.

With reference to FIG. 3, an electrically conductive member 10, such as a busbar, according to one exemplary embodiment, is shown. In this exemplary embodiment, the electrically conductive member 10 has contact areas 12, such as contact pads, provided at either end thereof. However, other configurations of the electrically conductive member 10 are possible without departing from the scope of the invention. For example only one end of the busbar may have a contact area or pad 12 while the other end may be terminated using a different type of connection. With reference to FIG. 10, the busbar or electrically conductive member 10 may be used to electrically connect a first terminated cable assembly including a first power cable 14 and a first termination or mating connector or lug 16 to a second terminated cable assembly including a second cable 18 and a second termination or mating connector or lug 20.

Referring again to FIG. 10, each of the first and second connectors 16, 20 are terminated to their respective cables 14, 18 using known termination methods. The connectors 16, 20 may be formed of any suitable electrically conductive metal such as copper. In the exemplary embodiment, the connectors 16, 20 include a coupling portion or pad 24 extending from an end thereof. A bolt bore or opening 33 (FIG. 9) is defined in each pad 24.

The electrically conductive member 10 may be referred to as an in-line busbar and includes, as shown in FIGS. 3 through 10 an electrically conductive body 32 and the electrically conductive contact areas or pads 12 extending from opposed sides of the body 32. The conductive body 32 and contact areas 12 may be integrally formed (e.g., cast or machined) of a suitable metal such as copper or aluminum. An electrically conductive grounding opening, projection or bore 34 (FIG. 3) may also extend from the body 32. A grounding wire (not shown) may be electrically connected to the bore 34 to provide grounding of the busbar body 32. An insulation layer (not shown) may surround the busbar body 32 such that the contact areas 12 remain exposed. The insulation layer may be formed of a suitable electrically insulating elastomer such as EPDM.

Figure 4:
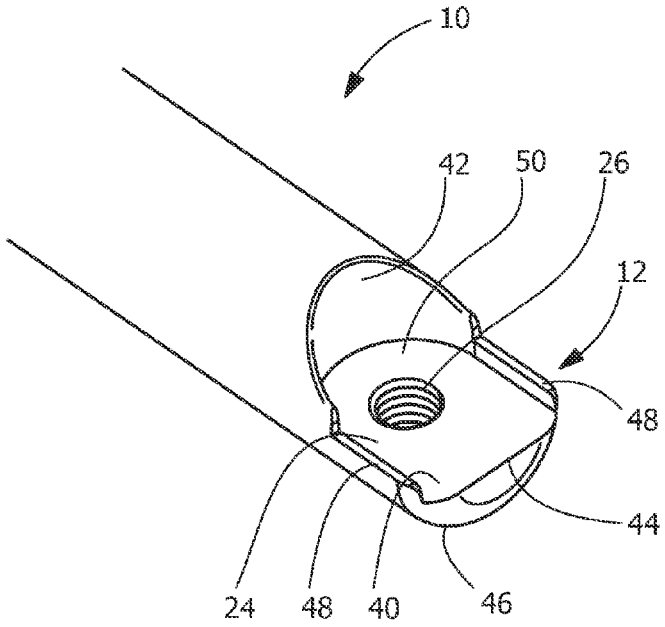
FIG. 4 is a top perspective view of the contact area of FIG. 3.

As best shown in FIG. 4, each contact area 12 has an engagement surface or flat upper surface 40 which extends from a shroud or wall 42 to a free end 44 of the electrically conductive member 10. The shroud 42 extends vertically or approximately ninety degrees from the engagement surface 40. In the exemplary embodiment, the shroud 42 has an arcuate configuration which has been machined into the body 32. The engagement or flat surface 40 has a threaded bore or opening 26 which extends therethrough. In the embodiment shown, the threaded opening 26 extends from the flat surface 40 through a bottom surface 46 of the electrically conductive member 10. While a bore is shown, the engagement surface may have various types of fastening members that cooperate with the mating connector to maintain the mating connector in position relative to the contact region. Such other types of fastening members include, but are not limited to, a post.

Projections 48, such as ribs, are positioned proximate the edges of the surface 40. The projections or ribs 48 extend from proximate the shroud 42 to proximate the free end 44. The projections 48 may be machined into the electrically conductive member 10. While two projections 48 are shown in the exemplary embodiment, other configurations of projections are possible, including, but not limited to, only one projection positioned proximate one edge of the surface 40. The surface 40 of the contact area 12, shroud 42 and projections 48 form a contact region or pocket 50 into which a respective mating connector 16, 20 is positioned.

Figure 5:
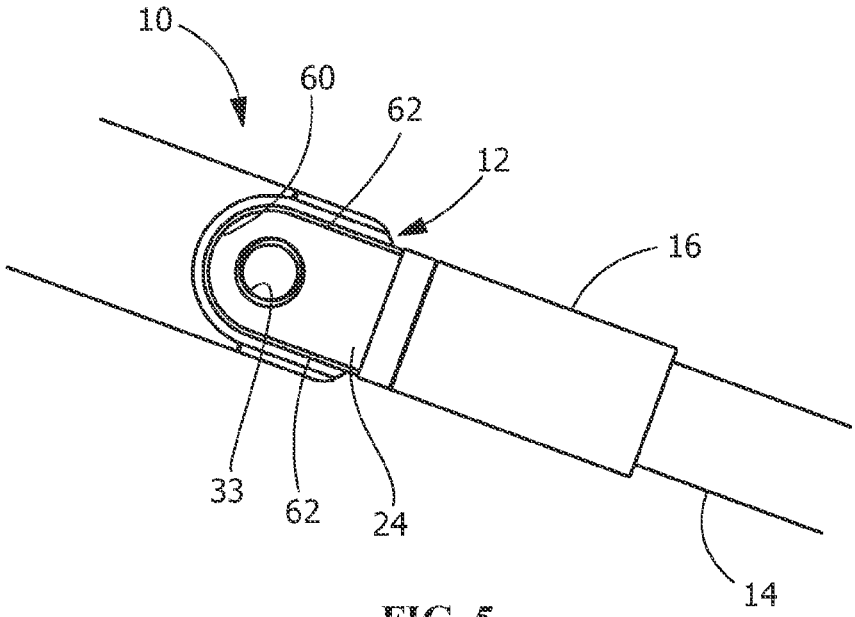
FIG. 5 is a top view of a mating connector mated with the contact area of FIG. 3.
Figure 9:
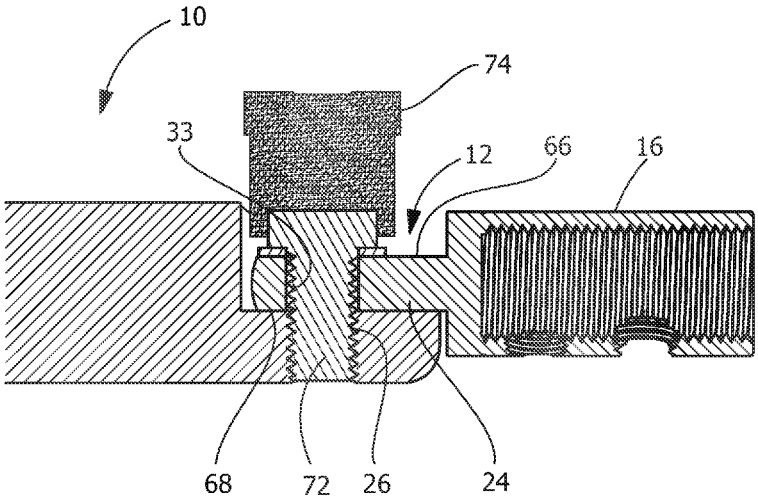
FIG. 9 is a cross-sectional view showing a socket engaging the bolt which secures the mating connector to the contact area of FIG. 3.

FIG. 5 illustrates a respective mating connector 16 positioned in a respective contact region or pocket 50 of the electrically conductive member 10. The coupling portion 24 of the mating connector 16 has an arcuate free end 60 and side edges 62. As best shown in FIG. 9, the opening 33 of connector 16 extends from a first surface 66 of the coupling portion 24 through an oppositely facing second surface 68. As shown in FIG. 5, the coupling portion 24 of the mating connector 16 is moved into engagement with the contact area 12 of the electrically conductive member 10. In this position, the arcuate free end 60 is positioned proximate shroud 42. As the arcuate free end 60 and the shroud 42 have similar shapes, the alignment of the mating connector 16 on the contact area 12 is made easier and faster. With the end 60 and shroud 42 properly aligned, the opening 33 of the mating connector 16 is easily aligned with the opening 26 of the contact area 12.

Figure 6:
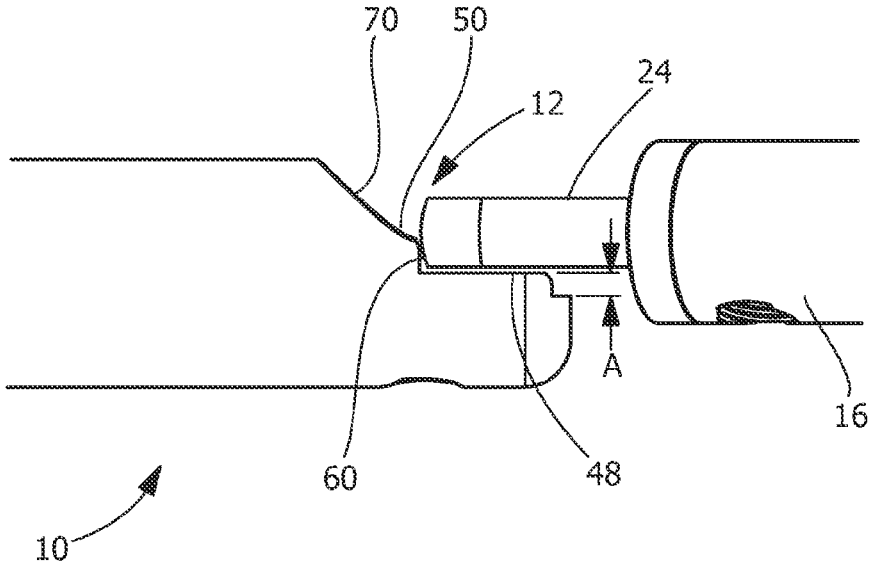
FIG. 6 is a side view of a mating connector prior to being seated in the contact area of FIG. 3.
Figure 7:
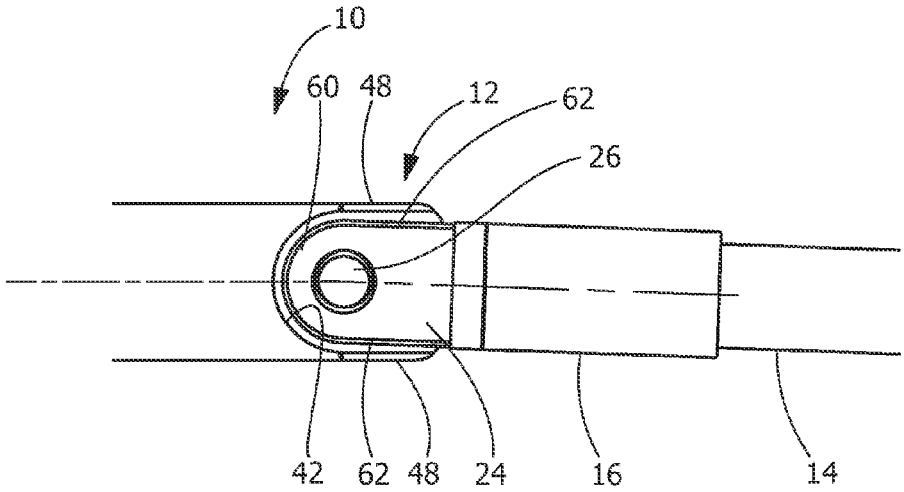
FIG. 7 is a top view of the contact area of FIG. 3 and a mating connector showing the mating connector rotated slightly relative to the contact area.

Referring to FIG. 6, the height A of the projections 48 are sized to allow the mating connector 16 to pass over them for ease of insertion. However, the projections 48 have sufficient height or depth A to allow the projections 48 to cooperate with the side edges 62 to prevent excessive rotation of the mating connectors 16 relative to the electrically conductive member 10. In other words, as the coupling portion 24 of the mating connector 16 is fully mated with the contact area 12, the second surface 68 of the coupling portion 24 engages the surface 40 of contact area 12. As this occurs, the side edges 62 of the coupling portion 24 are captured in the contact region or pocket 50. Consequently, as shown in FIG. 7, as a rotational force is applied to the mating connector 16, the side edges 62 will engage the projections 48 to prevent the excessive rotation of the connector 16. While excess rotation is prohibited, the mating connector 16 is permitted to rotate slightly relative to the contact area 12, thereby allowing for ease of mating of the mating connector 16 to the contact area 12, even if the cable 14 and the electrically conductive member 10 are not perfectly aligned.

As best shown in FIG. 6, the shroud 42 has a chamfered configuration when viewed from the side. This chamfered configuration provides a gradual lead-in surface 70 so that the rip cord of cold shrink tubing does not get caught on any vertical wall, thereby minimizing the possibility of damage to the tubing. The chamfered edges 70 also eliminate sharp metal edges of the contact area 12 which could otherwise become damaged if dropped or collided with the mating connector 16.

Figure 8:
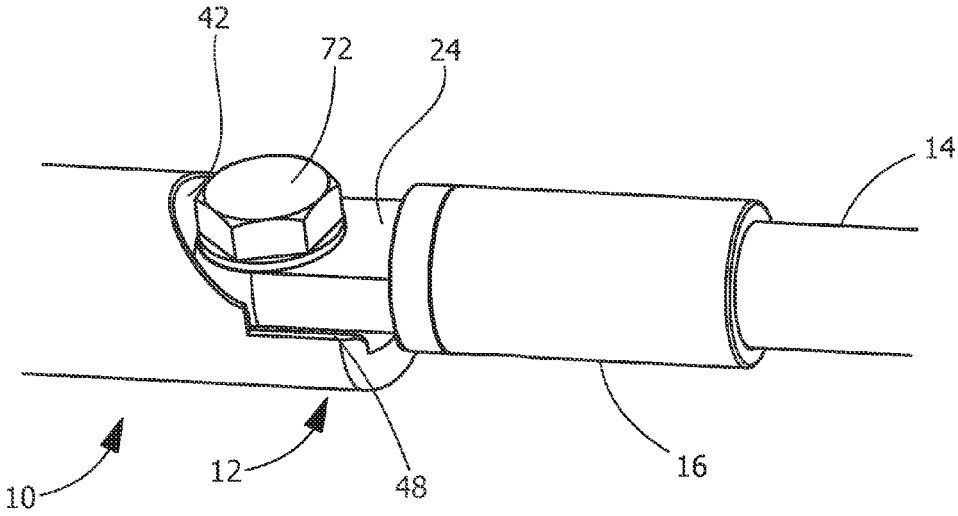
FIG. 8 is a top perspective view of the contact area of FIG. 3 and a mating connector secured together by a bolt.

Referring to FIGS. 8, 9 and 10, the mating connector 16 is secured to the contact area 12 of the electrically conductive member 10 by a removable threaded bolt 72, which extends through opening 33 and opening 26. Similarly, if a second mating connector 20 is provided, the second mating connector 20 is secured to a respective contact area 12 on the opposite side of the electrically conductive member 10 by a removable threaded bolt 72. Other embodiments may use a shear bolt or other types of known mechanical fasteners. One advantage of a shear bolt is that it's head may shear off flush with the coupling portion 24 when tightened, thereby providing an unobstructed path for installation of shrink tubing or the like. As shown in FIG. 9, the clearance provided between the wall 42 and the bolt 72 is such that a standard socket 74 may be used to install the bolt 72.

The busbar claimed herein provides for a reliable connection which allows the busbar and mating connectors to be properly mated, even if the connectors and busbar are not perfectly aligned. In addition, by preventing the excessive rotation of the mating connector, the mating connector will not cause the bolt to loosen over time, thereby preventing the mechanical and/or electrical failure of the connection.

The busbar also allows fast and accurate alignment of the mating connectors to the busbar. The shroud of the busbar aligns the mating connector to the pad. This ease of alignment is critical when considering the weight and stiffness of the cable to be mated with the busbar.

While the written description has referred to a preferred embodiment, it will be understood by those skilled in the art that various changes and modifications may be made and equivalents may be substituted for elements thereof without departing from the patentable scope as defined by the claims. In addition, many modifications may be made to adapt a particular situation or material to the teachings without departing from the essential scope thereof. Therefore, it is intended that the patentable scope not be limited to the particular embodiments disclosed as the best mode contemplated, but rather the invention will include any and all embodiments falling within the scope of the claims.

The invention claimed is:

1. A contact region of an electrically conductive member, the contact region comprising:

a contact area for electrically engaging a mating connector, the contact area having an engagement surface extending from a shroud to a free end of the electrically conductive member;

the shroud positioned proximate the engagement surface;

at least one projection proximate the contact area;

the engagement surface, the shroud and the at least one projection forming a pocket into which the mating connector is positioned, wherein the at least one projection cooperates with the mating connector to limit the rotation of the mating connector relative to the contact area.

2. The contact region of the electrically conductive member as recited in claim 1, wherein the electrically conductive member has respective contact regions provided at respective ends thereof.

3. The contact region of the electrically conductive member as recited in claim 1, wherein the contact area and the shroud are integrally formed from the electrically conductive member.

4. The contact region of the electrically conductive member as recited in claim 1, wherein the engagement surface has a fastening member which cooperates with the mating connector to maintain the mating connector in position relative to the contact region.

5. The contact region of the electrically conductive member as recited in claim 1, wherein at least one projection is positioned proximate an edge of the contact area.

6. The contact region of the electrically conductive member as recited in claim 5, wherein the at least one projection extends from proximate the shroud to proximate a free end of the electrically conductive member.

7. The contact region of the electrically conductive member as recited in claim 1, wherein the shroud has a chamfered configuration which provides a lead-in surface whereby damage to the contact area and insulation applied to the electrically conductive member is minimized.

8. A contact region of an electrically conductive member, the contact region comprising:

a contact area for electrically engaging a mating connector, the contact area having an engagement surface extending from an arcuate shroud to a free end of the electrically conductive member;

the arcuate shroud extending substantially vertically from the engagement surface, the arcuate shroud dimensioned to cooperate with an arcuate free end of the mating connector to align the mating connector in the contact area;

at least one projection provided proximate the contact area, the at least one projection cooperates with the mating connector to limit the rotation of the mating connector relative to the contact area;

the engagement surface, the arcuate shroud and the at least one projection forming a pocket into which the mating connector positioned.

9. The contact region of the electrically conductive member as recited in claim 8, wherein the electrically conductive member has respective contact regions provided at respective ends thereof.

10. The contact region of the electrically conductive member as recited in claim 8, wherein the engagement surface has a fastening member which cooperates with the mating connector to maintain the mating connector in position relative to the contact region.

11. The contact region of the electrically conductive member as recited in claim 8, wherein the at least one projection extends from proximate the shroud to proximate a free end of the electrically conductive member.

12. The contact region of the electrically conductive member as recited in claim 8, wherein the shroud has a chamfered configuration which provides a lead-in surface whereby damage to the contact area and insulation applied to the electrically conductive member is minimized.

13. A contact region of an electrically conductive member, the contact region comprising:

a contact area for electrically engaging a mating connector, the contact area having an engagement surface extending from a shroud to a free end of the electrically conductive member;

the shroud positioned proximate the contact area, the shroud dimensioned to cooperate with a portion of the mating connector to align the mating connector in the contact area;

at least one projection provided proximate the contact area, the at least one projection cooperates with the mating connector to limit the rotation of the mating connector relative to the contact area;

the engagement surface, the shroud and the at least one projection forming a pocket into which the mating connector positioned.

14. The contact region of the electrically conductive member as recited in claim 13, wherein the electrically conductive member has respective contact regions provided at respective ends thereof.

15. The contact region of the electrically conductive member as recited in claim 13, wherein the engagement surface has a fastening member which cooperates with the mating connector to maintain the mating connector in position relative to the contact region.

16. The contact region of the electrically conductive member as recited in claim 13, wherein the shroud has a chamfered configuration which provides a lead-in surface whereby damage to the contact area and insulation applied to the electrically conductive member is minimized.

* * * * *